US007387092B2

(12) United States Patent
Nishikawa et al.

(10) Patent No.: US 7,387,092 B2
(45) **Date of Patent: *Jun. 17, 2008**

(54) COMBUSTION-TYPE POWER TOOL HAVING COOLING ARRANGEMENT

(75) Inventors: Tomomasa Nishikawa, Hitachinaka (JP); Yoshitaka Akiba, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/764,953

(22) Filed: Jun. 19, 2007

(65) Prior Publication Data

US 2007/0240651 A1 Oct. 18, 2007

Related U.S. Application Data

(63) Continuation of application No. 11/208,593, filed on Aug. 23, 2005, now Pat. No. 7,237,515.

(30) Foreign Application Priority Data

Aug. 24, 2004 (JP) ..... P2004-243987

(51) Int. Cl.
*F02B 71/00* (2006.01)
*B25C 1/12* (2006.01)

(52) U.S. Cl. ..... 123/46 SC; 227/10

(58) Field of Classification Search ... 123/46 R–46 H; 227/10

See application file for complete search history.

(56) References Cited

U.S. PATENT DOCUMENTS

| | | | |
|---|---|---|---|
| 4,522,162 | A | 6/1985 | Nikolich |
| 5,197,646 | A | 3/1993 | Nikolich |
| 6,145,724 | A | 11/2000 | Shkolnikov |
| 6,796,476 | B2 | 9/2004 | Birk |
| 6,889,885 | B2 | 5/2005 | Ohmori |

FOREIGN PATENT DOCUMENTS

| | | |
|---|---|---|
| EP | 0 857 546 | 8/1998 |
| EP | 1 391 270 | 2/2004 |

*Primary Examiner*—Noah P. Kamen
(74) *Attorney, Agent, or Firm*—Antonelli, Terry, Stout & Kraus, LLP.

(57) ABSTRACT

A combustion-type power tool includes a housing, a cylinder, a cylinder head, a combustion chamber frame, and a rotatable fan. The combustion chamber frame including a base section, a head section abuttable on the cylinder head to provide a combustion chamber when the combustion chamber frame is at a first position, and a connection portion for connecting the head section with the base section. The fan includes fan blades which define a widthwise center line and having widthwise edge portions which define a widthwise edge line at a side of the cylinder head. The widthwise center line is offset from the connection portion toward another end of the housing, and the widthwise edge line is offset from the connection portion toward the cylinder head when the combustion chamber frame is at a second position.

7 Claims, 2 Drawing Sheets

COMBUSTION-TYPE POWER TOOL HAVING COOLING ARRANGEMENT

CROSS REFERENCE TO RELATED APPLICATION

This application is a continuation of U.S. application Ser. No. 11/208,593, filed Aug. 23, 2005, now U.S. Pat. No. 7,237,515, the contents of which are incorporated herein by reference.

BACKGROUND OF THE INVENTION

The present invention relates to a combustion-type power tool, and more particularly, to such power tool capable of driving a fastener such as a nail, an anchor, and a staple into a workpiece.

In a conventional combustion-type power tool such as a nail gun, a mixture of air and gaseous fuel injected into a combustion chamber is ignited by a spark at an ignition plug to cause gas expansion in the combustion chamber, which in turn causes a linear momentum of a piston. By the movement of the piston, a nail is driven into a workpiece. Such conventional combustion-type nail gun is described in U.S. Pat. No. 5,197,646 and Japanese Patent Publication No. H03-25307.

However, there has been a demand of cooling a component such as a cylinder.

SUMMARY OF THE INVENTION

The present inventors contemplated optimum position of a fan within a combustion chamber so as to provide an optimum air flow and air flow amount for cooling the component such as a cylinder.

It is therefore an object of the present invention to provide a combustion-type power tool capable of providing a sufficient amount of fan flow for efficiently cooling a component such as a cylinder by setting a fan at an optimum position.

This and other object of the present invention will be attained by a combustion-type power tool including a housing, a cylinder head, a cylinder, a piston, a push lever, a combustion chamber frame, a driver blade, an ignition plug, and a fan.

The housing has one end and another end and is formed with an exhaust port The cylinder head is disposed at the one end. The cylinder is disposed in and fixed to the housing. The cylinder defines an axial direction. The piston is slidably disposed in the cylinder and reciprocally movable in the axial direction. The push lever is disposed at the another end of the housing and movable in the axial direction upon pressing against a workpiece. The combustion chamber frame is disposed in the housing and movable in the axial direction. The combustion chamber frame includes a base section and a head section. The base section is associated with the push lever, and has one end which is a remote side from the push lever. The head section is fixed to the one end of the base section and abuttable on the cylinder head. The head section includes a disc like connecting portion having a radially outer edge connected to the one end of the base section and having a radially inner edge, and a sleeve like abutment portion extending in the axial direction from the radially inner edge toward the cylinder head and abuttable on the cylinder head to provide a combustion chamber in cooperation with the cylinder head and the piston.

The driver blade extends in the axial direction from the piston toward the another end of the housing. The ignition plug is exposed to the combustion chamber for igniting a mixture of air and the combustible gas in the combustion chamber. The fan is rotatably disposed in the combustion chamber for agitating and mixing the air with the combustible gas. The fan includes fan blades which define a widthwise center line in the axial direction. The widthwise center line is offset from the connecting portion and toward the piston in a non-operational phase.

In another aspect of the invention, there is provided a combustion-type power tool including a housing, a cylinder head, a combustion chamber, and a fan. The housing has one end and another end. The housing defines one direction which goes from the one end to the another end. The cylinder head is disposed at the one end. The combustion chamber frame is disposed in the housing and reciprocally movable in the one direction between a closed position in contact with the cylinder head and an open position out of contact from the cylinder head. The combustion chamber frame includes a base section and a head section. The head section is fixed to the base section and abuttable on the cylinder head. The head section includes a disc like connecting portion and a sleeve like abutment portion. The connection portion has a radially outer edge connected to the base section and has a radially inner edge. The abutment portion extends in the one direction from the radially inner edge toward the cylinder head and abuttable on the cylinder head to provide a combustion chamber in cooperation with the cylinder head. The fan is rotatably disposed in the combustion chamber. The fan includes fan blades which define a widthwise center line in the one direction. The widthwise center line is offset from the connecting portion in the one direction and toward the another end of the housing in the open position.

DETAILED DESCRIPTION OF THE PREFERRED EMBODIMENTS

Figure 1:
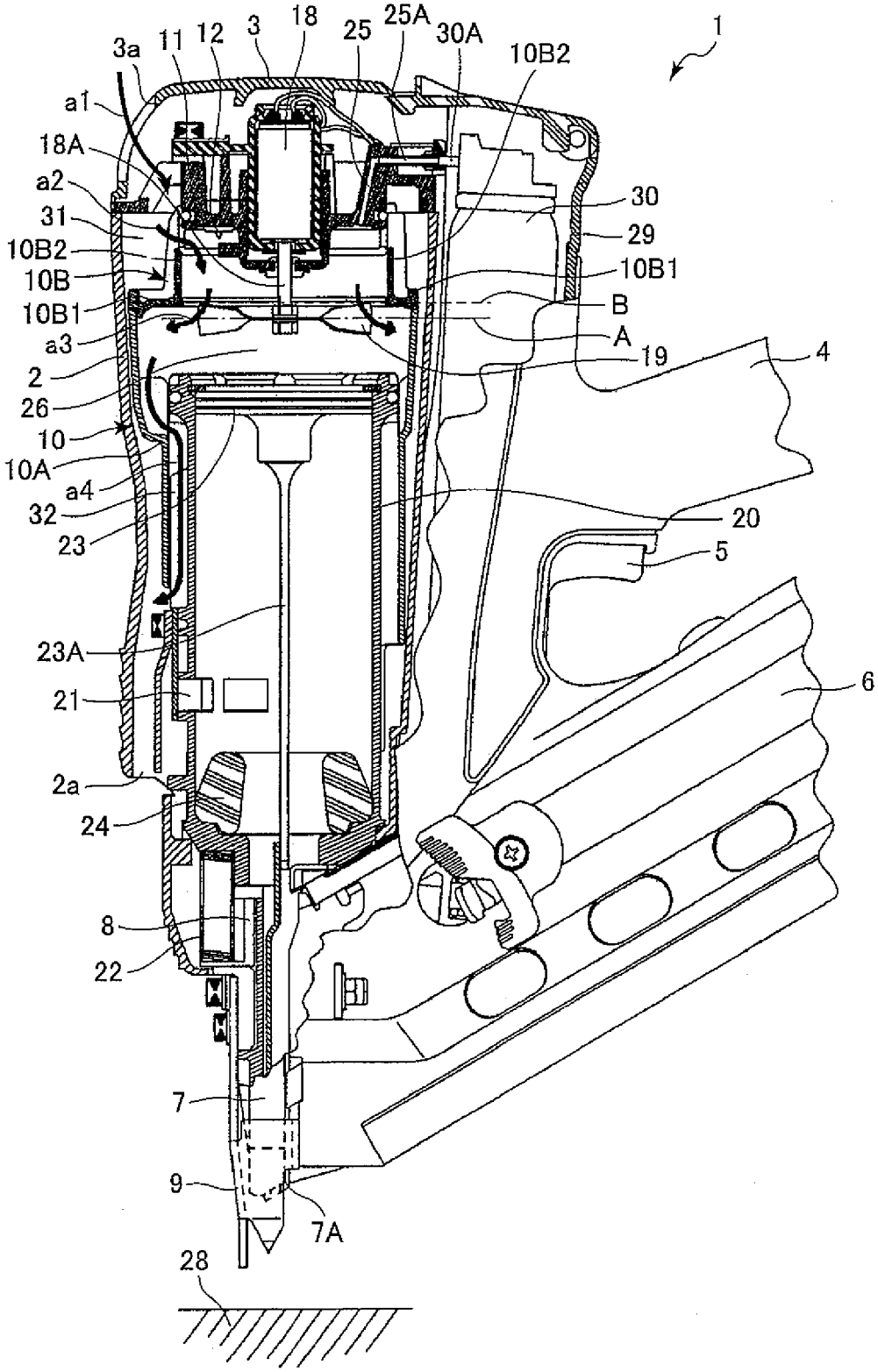
FIG. 1 is a vertical cross-sectional side view showing a combustion-type nail gun embodying a combustion-type power tool according to an embodiment of the present invention, the nail gun being in an initial phase prior to nail driving operation.

A combustion-type power tool according to one embodiment of the present invention will be described with reference to FIG. 1. The embodiment pertains to a combustion-type nail gun. Throughout the specification, the term "upper" and "lower" are used assuming that the combustion-type nail gun is oriented in a vertical direction. The combustion-type nail gun 1 has a housing 2 constituting an outer frame. The housing is formed with an exhaust port 2*a*. A head cover 3 formed with an intake port 3*a* is mounted on the top of the housing 2. A handle 4 is attached to the housing 2 and extends from a side of the housing 2.

The handle 4 has a trigger switch 5 and accommodates therein a battery (not shown). The battery is detachably disposed in the handle 4. A canister housing 29 is provided in the housing 2 at a position immediately beside the handle 4. The gas canister 30 is detachably disposed in the canister housing 29. The gas canister 30 includes an injection rod 30A to be connected to a gas canister connecting portion 25A provided in a cylinder head 11 (described later), A magazine 6 for containing therein nails (not shown) is provided at a lower side of the handle 4 of the housing 2.

A nose 7 extends from an end of the housing 2, the end being opposite to the head cover 3. The nose 7 is formed integrally with a cylinder 20 (described later) and has a tip end in confrontation with a workpiece 28. The nose 7 is adapted for guiding sliding movement of a drive blade 23A (described later) and the nail. A push lever 9 is movably provided and has a lower portion slidable with respect to a lower end portion 7A of the nose 7. The push lever 9 has a tip end adapted to be pressed against the workpiece 28, and has an upper end portion associated with an arm member 8 fixed to a base section 10A of a combustion chamber frame 10 which will be described later.

A compression coil spring 22 is interposed between the arm member 8 and the cylinder 20 for normally urging the push lever 9 in a protruding direction away from the head cover 3. When the housing 2 is pressed toward the workpiece 28 while the push lever 9 is in abutment with the workpiece 28 against a biasing force of the compression coil spring 22, an upper portion of the push lever 9 is retractable into the housing 2.

A cylinder head 11 is secured to the top of the housing 2 for closing the open top end of the housing 2. The cylinder head 11 supports a motor 18 at a position opposite to a combustion chamber 26 described later. Further, an ignition plug 12 is also supported to the cylinder head 11 at a position adjacent to the motor 18. The ignition plug 12 has an ignition spot exposed to the combustion chamber 26. The ignition plug 12 is ignitable upon manipulation to the trigger switch 5 and upon movement of the combustion chamber frame 10 to its predetermined position because of the pressing of the push lever 9 against the workpiece 28. The motor 18 has a rotation shaft 18A, and a fan 19 positioned in the combustion chamber 26 is fixed to a tip end of the rotation shaft 18A.

The cylinder head 11 has a handle side in which is formed a fuel injection passage 25 which allows a combustible gas to pass therethrough. One end of the fuel injection passage 25 serves as an injection port that opens at the lower surface of the cylinder head 11. Another end of the fuel injection passage 25 is engaged with the gas canister connecting portion 25A in communication with the injection rod 30A.

The combustion chamber frame 10 is provided in the housing 2 and is movable in the lengthwise direction of the housing 2. The combustion chamber frame 10 includes the base section 10A and a head section 10B extending from the base section 10A at a position opposite to the push lever 9. The head section 10B includes a radial connecting portion 10B1 having an outer end connected to the base section 10A and extending radially inwardly toward the rotation shaft 18A, and an abutment portion 10B2 extending in parallel with the rotation shaft 18A from a radially inner end of the connecting portion 10B1. The abutment portion 10B2 is movable to abut on and away from the cylinder head 11. The combustion chamber frame 10 is moved interlockingly in accordance with the movement of the push lever 9, since the arm member 8 is fixed to the base section 10A.

A head switch (not shown) is provided in the housing 2 for detecting an uppermost stroke end position of the combustion chamber frame 10 when the nail gun 1 is pressed against the workpiece 28. The head switch can be turned ON when the push lever 9 is elevated to a predetermined position for starting rotation of the motor 18.

The cylinder 20 is fixed to the housing 2. The combustion chamber frame 10 has an inner surface in sliding contact with the cylinder 20. Thus, the cylinder 20 guides movement of the combustion chamber frame 10. The cylinder 20 has an axially intermediate portion formed with an exhaust hole 21. An exhaust-gas check valve (not shown) is provided to selectively close the exhaust hole 21.

A piston 23 is slidably and reciprocally provided in the cylinder 20. The piston 23 divides an inner space of the cylinder 20 into an upper space above the piston 23 and a lower space below the piston 23. The driver blade 23A extends downwards from a side of the piston 23, the side being at the cylinder space below the piston 23, to the nose 7. The driver blade 23A is positioned coaxially with the nail setting position in the nose 7, so that the driver blade 23A can strike against the nail during movement of the piston 23 toward its bottom dead center. Further, a bumper 24 is provided on the bottom of the cylinder 20. The bumper 24 is made from a resilient material. When the piston 23 moves to its bottom dead center, the piston 23 abuts on the bumper 24 and stops. In this case, the bumper 24 absorbs a surplus energy of the piston 23.

When the upper end of the abutment portion 10B2 of the combustion chamber frame 10 abuts on the cylinder head 11, the cylinder head 11, the combustion chamber frame 10, and the upper cylinder space above the piston 23 define in combustion the combustion chamber 26. When the abutment portion 10B2 is separated from the cylinder head 11, a first flow passage 31 in communication with an atmosphere is provided between the cylinder head 11 and the abutment portion 10B2, and a second flow passage 32 in communication with the first flow passage 31 is provided between the base section 10A of the combustion chamber frame 10 and the upper end portion of the cylinder 20. These flow passages 31, 32 allow a combustion gas and a fresh air to pass along the outer peripheral surface of the cylinder 20 for discharging these gas through the exhaust port 2*a* of the housing 2. Further, the above-described intake port 3*a* is formed for supplying a fresh air into the combustion chamber 26, and the exhaust hole 21 is adapted for discharging combustion gas generated in the combustion chamber 26.

During non-operational state of the fan 19, a widthwise center line (line A) of the fan blade in an axial direction of the rotation shaft 18A is offset from the connecting portion 10B1 toward the push lever 9. In other words, the widthwise center line A is closer to the push lever 9 than the connecting portion 10B1 to the push lever 9. Further, the fan blade has one end positioned close to the cylinder head 11. The one end of the fan blade (line B) is positioned coincident with the connecting portion 10B1, or the line 3 is offset from the connecting portion 10B1 toward the cylinder head 11 in the axial direction of the rotation shaft 18A. That is, the line B is closer to the cylinder head 11 than the connecting portion 10B1 to the cylinder head 11 in the non-operational phase of the fan 19.

Rotation of the fan 19 performs the following three functions. First, the fan 19 stirs and mixes the air with the combustible gas as long as the combustion chamber frame 10 remains in abutment with the cylinder head 11. Second, after the mixed gas has been ignited, the fan 19 causes turbulent is combustion of the air-fuel mixture, thus promoting the combustion of the air-fuel mixture in the combustion chamber 26. Third, the fan 19 performs scavenging such that the exhaust gas in the combustion chamber 26 can be scavenged therefrom and also performs cooling to the combustion chamber frame 10 and the cylinder 20 when the combustion chamber frame 10 moves away from the cylinder head 11 and when the first and second flow passages 31, 32 are provided.

Next, operation of the combustion-type nail gun 1 will be described. In the non-operational state of the combustion-type nail gun 1, the push lever 9 is biased away from the cylinder head 11 as shown in FIG. 1 by the biasing force of the compression coil spring 22, so that the push lever 9 protrudes from the lower end of the nose 7. Thus, the uppermost end portion of the abutment portion 10B2 is spaced away from the cylinder head 11 because the arm member 8 connects the combustion chamber frame 10 to the push lever 9. Further, a part of the base section 10A which part defines the combustion chamber 26 is also spaced away from the top portion of the cylinder 20. Hence, the first and second flow passages 31 and 32 are provided. In this condition, the piston 23 stays at its top dead center in the cylinder 20.

With this state, if the push lever 9 is pushed onto the workpiece 28 while holding the handle 4 by a user, the push lever 9 is moved toward the cylinder head 11 against the biasing force of the compression coil spring 22. At the same time, the combustion chamber frame 10 which is associated with the push lever 9 through the arm member 8 is also moved toward the cylinder head 11, closing the above-described flow passages 31 and 32. Thus, the sealed combustion chamber 26 is provided.

In accordance with the movement of the push lever 9, the liquidized gas in the gas canister 30 is injected into the combustion chamber 26 through the gas canister connecting portion 25A and through the fuel injection passage 25.

Further, in accordance with the movement of the push lever 9, the combustion chamber frame 10 reaches its uppermost stroke end whereupon the head switch is turned ON to energize the motor 18 for starting rotation of the fan 19. Rotation of the fan 19 stirs and mixes the combustible gas with air in the combustion chamber 26.

In this state, when the trigger switch 5 provided at the handle 4 is turned ON, spark is generated at the ignition plug 12 to ignite the combustible gas. The combusted and expanded gas pushes the piston 23 to its bottom dead center. Therefore, a nail in the nose 7 is driven into the workpiece 28 by the driver blade 23A until the piston 23 abuts on the bumper 24.

After the nail driving, the piston 23 strikes against the bumper 24, the cylinder space above the piston 23 becomes communicated with the exhaust hole 21. Thus, the high pressure and high temperature combustion gas is discharged out of the cylinder 20 through the exhaust hole 21 of the cylinder 20 and through the check valve (not shown) provided at the exhaust hole 21 to the atmosphere to lower the pressure in the combustion chamber 26. When the inner space of the cylinder 20 and the combustion chamber 26 becomes the atmospheric pressure, the check valve is closed.

Combustion gas still remaining in the cylinder 20 and the combustion chamber 26 has a high temperature at a phase immediately after the combustion. However, the high temperature can be absorbed into the walls of the cylinder 20 and the combustion chamber frame 10. The absorbed heat is diffused to the atmosphere from the cylinder 20 and the combustion chamber frame 10.

Absorption of the heat into the cylinder 20 etc. causes rapid cooling to the combustion gas. Thus, the pressure in the sealed space in the cylinder 20 above the piston 23 further drops to less than the atmospheric pressure (creating a so-called "thermal vacuum"). Accordingly, the piston 23 can be moved back to the initial top dead center position.

Then, the trigger switch 5 is turned OFF, and the user lifts the combustion-type nail gun 1 from the workpiece 28 for separating the push lever 9 from the workpiece 28. As a result, the push lever 9 and the combustion chamber frame 10 move away from the cylinder head 11 because of the biasing force of the compression coil spring 22 to restore a state shown in FIG. 1. Thus, the first and second flow passages 31 and 32 are provided. In this case, the fan 19 is configured to keep rotating for a predetermined period of time, for example 7 seconds or less after the detection of the predetermined position of the combustion chamber frame 10 by the head switch in spite of OFF state of the trigger switch 5. Thus, in the state shown in FIG. 1, fresh air is introduced into the combustion chamber 26 through the intake port 3*a* formed at the head cover 3 as indicated by an arrow "a1" by the rotation of the fan 19.

The fresh air then flows through the first flow passage 31 as indicated by an arrow "a2". Here, sufficient fan velocity pressure is required in order to provide a smooth air flow, since cross-sectional areas of the second flow passage 32 and the exhaust port 2*a* those positioned downstream of the air flow "a2" are small. In order to provide high fan velocity pressure, the fan 19 and its ambient arrangement should allow the air flow immediately discharged from the fan 19 to be directed radially outwardly of the fan 19 as indicated by an arrow "a3". In the present embodiment, since the widthwise center portion (line A) of the fan blade is offset toward the push lever 9 from the connecting portion 10B1, the air flow immediately discharged from the fan 19 is not interrupted by the connecting portion 10B1 and the abutment portion 10B2.

Further, since the one end of the fan blade (line B) is positioned coincident with the connecting portion 10B1, or the line B is offset from the connecting portion 10B1 toward the cylinder head 11 in the axial direction of the rotation shaft 18A, the air flow discharged from the fan 19 will not be self-circulated within the combustion chamber 26. Accordingly, air can smoothly flow toward the second flow passage 32. As a result, flow rate passing through the first and second flow passages 31, 32 can be increased. Then, the air passes through the second flow passage 32 and is discharged to the atmosphere through the exhaust port 2*a* as indicated by an arrow "a4". Consequently, residual combustion gas in the combustion chamber 26 can be expelled out of the exhaust port 2*a*. Thus, the combustion chamber 26 is scavenged.

The air flow can also cool the walls of the cylinder 20 and the combustion chamber frame 10 having high temperature. Since high fan flow rate can be provided in the embodiment, sufficient cooling efficiency to the cylinders etc. can be provided, to enhance operability to the tool particularly for the continuous repeated nail driving operation. In other words, electrical power supplying period to the motor 18 for rotating the fan 19 can be reduced. For example, in a conventional nail gun, a fan is configured to keep rotating for not less than 8 seconds after the detection of the predetermined position of the combustion chamber frame 10 by the head switch in order to sufficiently cool the components. On the contrary, in the present embodiment, the power supplying period is less than 8 seconds, such as 7 seconds or less, yet performing sufficient cooling function. This implies that the battery can provide an increased numbers of nail driving times, i.e., prolonged service life of the battery results. Then, the rotation of the fan 19 is stopped to restore an initial stationary state. Thereafter, subsequent nail driving operation can be performed by repeating the above described operation process.

Figure 2:
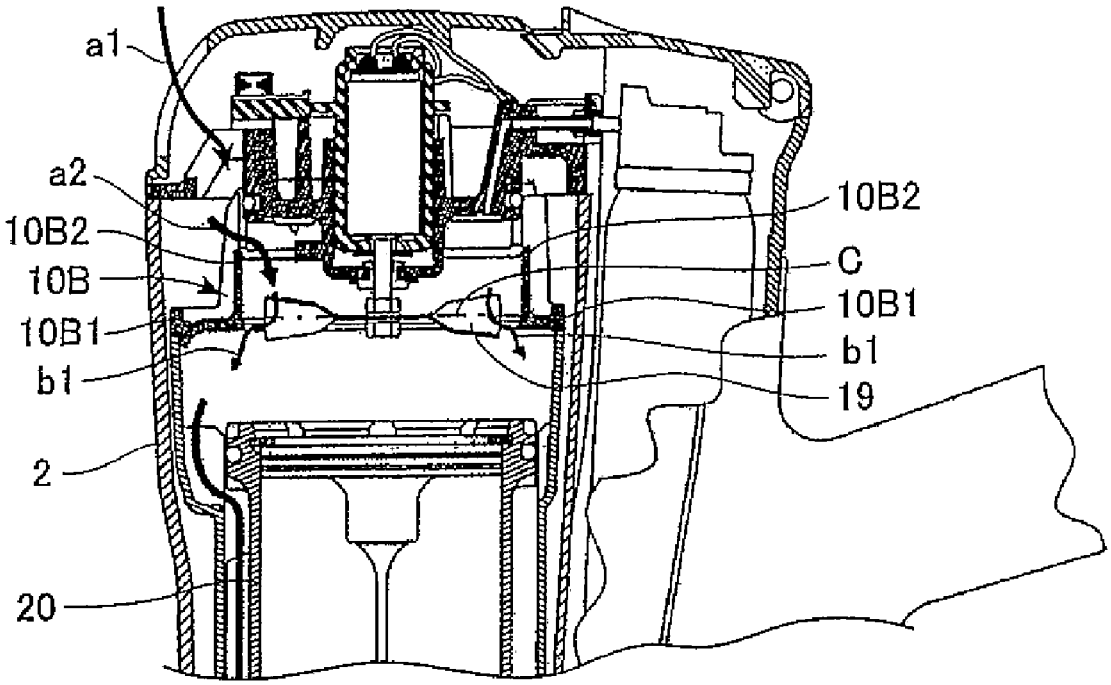
FIG.2 PRIOR ART
FIG. 2 is a partial cross-sectional side view showing a comparative combustion-type nail gun where a distance between a fan and a cylinder head is shorter than that in the embodiment of the present invention.

A comparative arrangement is shown in FIG. 2, in which a widthwise center (line C) of fan blades in the axial direction of the rotation shaft is offset toward the cylinder head 11 from the connecting portion 10B1. With this structure, air discharged from the fan 19 is impinged against the abutment portion 10B2 and the connecting portion 10B1 as indicated by an arrow b1 to disturb air flow. Consequently, sufficient flow rate is not obtainable to increase the period for cooling the cylinder 20 etc, to lower operability of the tool particularly for the repeated nail driving operation.

While the invention has been described in detail and with reference to specific embodiments thereof, it would be apparent to those skilled in the art that various changes and modification may be made therein without departing from the scope of the invention. For example, the present invention is not limited to the nail gun but is available for any kind of power tools in which a combustion chamber and a piston are provided, and as long as expansion of gas as a result of combustion of air-fuel mixture in the combustion chamber causes reciprocal motion of the piston.

What is claimed is:

1. A combustion-type power tool comprising:

a housing;

a cylinder disposed in the housing, the cylinder defining an axial direction;

a cylinder head disposed at an end of the housing;

a combustion chamber frame disposed in the housing and movable between a first position and a second position, the combustion chamber frame including a base section, a head section abuttable on the cylinder head to provide a combustion chamber when the combustion chamber frame is at the first position, and a connection portion for connecting the head section with the base section; and a fan rotatably disposed in the combustion chamber;

wherein the fan includes fan blades which define a widthwise center line and having widthwise edge portions of the fan blades which define a widthwise edge line at a side of the cylinder head; and wherein the widthwise center line is offset from the connection portion toward another end of the housing, and the widthwise edge line is offset from the connection portion toward the cylinder head when the combustion chamber frame is at the second position.

2. The combustion-type power tool as defined in claim 1, wherein the base section extends along the cylinder and is connected to a push lever, the push lever being movable in the axial direction against a workpiece; and wherein the head section extends in the axial direction toward the cylinder head.

3. The combustion-type power tool as defined in claim 1, wherein the connection portion is extended perpendicular to the axial direction and connects between the base section and the head section.

4. The combustion-type power tool as defined in claim 1, wherein the combustion chamber is formed by the cylinder head, the combustion chamber frame and an upper surface of a piston slidably disposed in the cylinder, when the combustion chamber frame is at the first position.

5. The combustion-type power tool as defined in claim 1, wherein an air flow passage is formed between the cylinder head and the head section of the combustion chamber frame, when the combustion chamber is at the second position.

6. The combustion-type power tool as defined in claim 1, further comprising a head switch disposed in the housing to detect a position of the combustion chamber frame relative to the housing.

7. The combustion-type power tool as defined in claim 6, wherein the fan is rotated for a period of not more than 7 seconds when the head switch detects that the combustion chamber frame is at a predetermined position.

* * * * *